US011879304B2

(12) United States Patent
Abeidoh et al.

(10) Patent No.: US 11,879,304 B2
(45) Date of Patent: Jan. 23, 2024

(54) REACTIVE METAL FOR CEMENT ASSURANCE

(71) Applicant: Halliburton Energy Services, Inc., Houston, TX (US)

(72) Inventors: Abdel-Hamid Rawhi Abeidoh, Dallas, TX (US); Bryon D Mullen, Spring, TX (US); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/322,496

(22) Filed: May 17, 2021

(65) Prior Publication Data

US 2022/0364432 A1 Nov. 17, 2022

(51) Int. Cl.
*E21B 33/14* (2006.01)
*E21B 33/124* (2006.01)

(52) U.S. Cl.
CPC ..... *E21B 33/14* (2013.01); *E21B 33/1243* (2013.01)

(58) Field of Classification Search
CPC ..... E21B 33/12
See application file for complete search history.

(56) References Cited

U.S. PATENT DOCUMENTS 1,982,569 A 11/1934 Byrd
3,046,601 A 7/1962 Hubbert et al.
3,175,618 A 3/1965 Lang et al.
3,385,367 A 5/1968 Kollsman
3,993,577 A 11/1976 Black et al.
4,445,694 A 5/1984 Flaherty
4,612,985 A 9/1986 Rubbo et al.
4,846,278 A 7/1989 Robbins
5,070,942 A 12/1991 McInnes
5,139,235 A 8/1992 Kilmer
5,163,321 A 11/1992 Perales
(Continued)

FOREIGN PATENT DOCUMENTS

CA 2751473 A1 8/2010
CA 2751473 C 9/2014
(Continued)

OTHER PUBLICATIONS

International Search Report and Written Opinion dated Aug. 2, 2018, International PCT Application No. PCT/US2017/061307.
(Continued)

*Primary Examiner* — William D Hutton, Jr.
*Assistant Examiner* — Avi T Skaist
(74) *Attorney, Agent, or Firm* — Barnes & Thornburg, LLP

(57) ABSTRACT

Methods and systems for cementing in a wellbore. An example method includes introducing a conduit into a wellbore. The conduit comprises a reactive metal element disposed on an exterior of the conduit. The reactive metal element comprises a reactive metal having a first volume. The method further includes circulating a cement over the exterior of the conduit and the reactive metal element, contacting the reactive metal element with a fluid that reacts with the reactive metal to produce a reaction product having a second volume greater than the first volume, and contacting a surface of the cement adjacent to the reactive metal element with the reaction product.

20 Claims, 5 Drawing Sheets

(56) References Cited

U.S. PATENT DOCUMENTS 5,803,177 A 9/1998 Hriscu et al.
6,098,717 A 8/2000 Bailey et al.
6,321,861 B1 11/2001 Leichter
6,367,845 B1 4/2002 Otten et al.
6,581,682 B1 6/2003 Parent et al.
6,640,893 B1 11/2003 Rummel et al.
6,695,061 B2 2/2004 Fripp et al.
7,007,910 B1 3/2006 Krinner et al.
7,040,404 B2 5/2006 Brothers et al.
7,387,158 B2 6/2008 Murray et al.
7,431,082 B2 10/2008 Holt et al.
7,543,639 B2 6/2009 Emerson
7,562,704 B2 7/2009 Wood et al.
7,578,347 B2 8/2009 Bosma et al.
7,591,319 B2 9/2009 Xu
7,909,110 B2 3/2011 Sharma et al.
7,931,079 B2 4/2011 Nicholson
7,984,762 B2 7/2011 Renshaw et al.
8,083,000 B2 12/2011 Nutley et al.
8,235,075 B2 8/2012 Saltel
8,240,377 B2 8/2012 Kulakofsky et al.
8,434,571 B2 5/2013 Kannan et al.
8,443,881 B2 5/2013 Thomson et al.
8,490,707 B2 7/2013 Robisson et al.
8,499,843 B2 8/2013 Patel et al.
8,776,899 B2 7/2014 Fripp et al.
9,033,046 B2 5/2015 Andrew et al.
9,091,133 B2 7/2015 Stewart et al.
9,133,683 B2 9/2015 Dyer et al.
9,404,030 B2 8/2016 Mazyar et al.
9,518,453 B2 12/2016 Dilber et al.
9,605,508 B2 3/2017 Xu et al.
9,624,752 B2 4/2017 Resink
9,702,029 B2 7/2017 Fripp et al.
9,725,979 B2 8/2017 Mazyar et al.
9,745,451 B2 8/2017 Zhao et al.
9,856,710 B2 1/2018 Zhu et al.
9,869,152 B2 1/2018 Gamstedt et al.
9,976,380 B2 5/2018 Davis et al.
10,119,011 B2 11/2018 Zhao et al.
10,364,636 B2 7/2019 Davis et al.
10,428,624 B2 10/2019 Vasques
10,704,362 B2 7/2020 Themig et al.
10,851,615 B2 12/2020 Watson et al.
10,961,804 B1 3/2021 Fripp et al.
2002/0125008 A1 9/2002 Wetzel et al.
2003/0150614 A1 8/2003 Brown et al.
2003/0159829 A1 8/2003 Fripp et al.
2004/0118572 A1 6/2004 Whanger et al.
2004/0149418 A1 8/2004 Bosma et al.
2004/0244994 A1 12/2004 Jackson
2005/0039927 A1 2/2005 Wetzel et al.
2005/0092485 A1 5/2005 Brezinski
2005/0171248 A1 8/2005 Li et al.
2005/0199401 A1 9/2005 Patel et al.
2005/0257961 A1 11/2005 Snell et al.
2006/0039927 A1 2/2006 Aoki et al.
2006/0175065 A1 8/2006 Ross
2007/0089911 A1 4/2007 Moyes
2007/0095532 A1 5/2007 Head et al.
2007/0125532 A1 6/2007 Murray et al.
2007/0200299 A1 8/2007 Kunz
2007/0257405 A1 11/2007 Freyer
2008/0066931 A1 3/2008 Xu
2008/0142214 A1 6/2008 Keller
2008/0149351 A1 6/2008 Marya et al.
2008/0185150 A1 8/2008 Brown
2008/0185158 A1 8/2008 Chalker et al.
2008/0194717 A1 8/2008 Vaidya et al.
2008/0220991 A1 9/2008 Slay et al.
2009/0020286 A1 1/2009 Johnson
2009/0120640 A1* 5/2009 Kulakofsky ..... C09K 8/467
166/295
2009/0130938 A1 5/2009 Xu et al.
2009/0173505 A1 7/2009 Patel et al.
2009/0179383 A1 7/2009 Koloy et al.
2009/0188569 A1 7/2009 Saltel
2009/0242189 A1 10/2009 Vaidya et al.
2009/0242214 A1 10/2009 Foster et al.
2009/0272546 A1 11/2009 Nutley et al.
2009/0277651 A1 11/2009 Kilgore
2009/0277652 A1 11/2009 Nutley et al.
2010/0038074 A1 2/2010 Patel
2010/0139930 A1 6/2010 Patel et al.
2010/0147535 A1 6/2010 Gorrara et al.
2010/0163252 A1* 7/2010 Regnault De La Mothe .....
C09K 8/422
166/387
2010/0212891 A1 8/2010 Stewart et al.
2010/0270031 A1 10/2010 Patel
2010/0307770 A1 12/2010 Sponchia et al.
2011/0073310 A1 3/2011 Clemens
2011/0098202 A1 4/2011 James et al.
2011/0174504 A1 7/2011 Wright et al.
2011/0226374 A1 9/2011 Kalman
2011/0252879 A1 10/2011 Madhavan et al.
2011/0253393 A1 10/2011 Vaidya et al.
2012/0006530 A1 1/2012 Crabb et al.
2012/0055667 A1 3/2012 Ingram et al.
2012/0073834 A1 3/2012 Lembcke
2012/0132427 A1 5/2012 Renshaw et al.
2012/0175134 A1 7/2012 Robisson et al.
2012/0205091 A1 8/2012 Turley et al.
2012/0205092 A1 8/2012 Givens et al.
2012/0272546 A1 11/2012 Tsai
2012/0292013 A1 11/2012 Munshi et al.
2012/0292023 A1 11/2012 Hinkie et al.
2012/0318513 A1 12/2012 Mazyar et al.
2013/0056196 A1 3/2013 Hench
2013/0056207 A1 3/2013 Wood et al.
2013/0056227 A1 3/2013 Sponchia
2013/0056228 A1 3/2013 Gruetzmann et al.
2013/0146312 A1 6/2013 Gerrard et al.
2013/0213032 A1 8/2013 Xu et al.
2013/0248179 A1 9/2013 Yeh et al.
2014/0051612 A1 2/2014 Mazyar et al.
2014/0054047 A1 2/2014 Zhou
2014/0060815 A1 3/2014 Wang et al.
2014/0102728 A1 4/2014 Gamstedt et al.
2014/0231086 A1 8/2014 Jamison et al.
2014/0238692 A1 8/2014 Watson
2014/0251641 A1 9/2014 Marya et al.
2014/0262351 A1 9/2014 Derby
2014/0318780 A1 10/2014 Howard
2014/0354443 A1 12/2014 Roberson et al.
2014/0361497 A1 12/2014 Porta
2015/0021044 A1 1/2015 Davis et al.
2015/0060064 A1 3/2015 Lafferty et al.
2015/0101813 A1 4/2015 Zhao et al.
2015/0199401 A1 7/2015 Polehn et al.
2015/0267501 A1 9/2015 Al-Gouhi
2015/0275644 A1 10/2015 Chen et al.
2015/0308214 A1 10/2015 Bilansky et al.
2015/0344772 A1 12/2015 Droger et al.
2015/0369027 A1 12/2015 Jones et al.
2016/0032696 A1 2/2016 Caccialupi et al.
2016/0047177 A1 2/2016 Martin et al.
2016/0097252 A1 4/2016 Resink
2016/0137912 A1 5/2016 Sherman et al.
2016/0138359 A1 5/2016 Zhao et al.
2016/0145965 A1 5/2016 Zhao et al.
2016/0194933 A1 7/2016 O'Brien et al.
2016/0201425 A1 7/2016 Walton et al.
2016/0215604 A1 7/2016 Potapenko
2016/0230495 A1 8/2016 Mazyar et al.
2016/0273299 A1 9/2016 Fripp et al.
2016/0312586 A1 10/2016 De Clute-Melancon
2016/0319633 A1 11/2016 Cooper et al.
2016/0326829 A1 11/2016 Dolog et al.
2016/0376869 A1 12/2016 Rochen et al.
2016/0376870 A1 12/2016 Roselier et al.
2017/0122062 A1 5/2017 Freyer
2017/0191343 A1 7/2017 Solhaug
2017/0234103 A1 8/2017 Frazier

(56) References Cited

U.S. PATENT DOCUMENTS

| | | | |
|---|---|---|---|
| 2017/0261137 | A1 | 9/2017 | Williams et al. |
| 2017/0335673 | A1 | 11/2017 | Burke et al. |
| 2018/0078998 | A1 | 3/2018 | Sherman |
| 2018/0085154 | A1 | 3/2018 | Kulper et al. |
| 2018/0087346 | A1 | 3/2018 | Rochen |
| 2018/0087350 | A1* | 3/2018 | Sherman ..... E21B 43/086 |
| 2018/0094492 | A1 | 4/2018 | Knapp et al. |
| 2018/0202271 | A1 | 7/2018 | Semple et al. |
| 2018/0216431 | A1 | 8/2018 | Walton, III et al. |
| 2018/0230772 | A1 | 8/2018 | Brandsdal et al. |
| 2018/0245420 | A1 | 8/2018 | Ringgenberg |
| 2018/0266215 | A1 | 9/2018 | Fagley, IV et al. |
| 2018/0320472 | A1 | 11/2018 | Fripp et al. |
| 2018/0355691 | A1 | 12/2018 | Andersen |
| 2018/0355693 | A1 | 12/2018 | Al-AbdulJabbar et al. |
| 2019/0017285 | A1 | 1/2019 | Kain |
| 2019/0055808 | A1 | 2/2019 | Krueger |
| 2019/0055839 | A1 | 2/2019 | Skillingstad et al. |
| 2019/0128074 | A1 | 5/2019 | Stokes et al. |
| 2019/0153852 | A1 | 5/2019 | Lallemand et al. |
| 2019/0203101 | A1 | 7/2019 | Dusterhoft et al. |
| 2019/0249509 | A1 | 8/2019 | Jakkula et al. |
| 2019/0264543 | A1 | 8/2019 | Sherman |
| 2019/0360297 | A1 | 11/2019 | Heiman et al. |
| 2020/0240235 | A1 | 7/2020 | Fripp et al. |
| 2020/0325749 | A1 | 10/2020 | Fripp et al. |
| 2020/0370391 | A1 | 11/2020 | Fripp et al. |
| 2021/0017441 | A1 | 1/2021 | Fripp et al. |
| 2021/0040810 | A1 | 2/2021 | Evers |
| 2021/0079756 | A1 | 3/2021 | Ornelaz et al. |
| 2021/0140255 | A1 | 5/2021 | Greci et al. |
| 2021/0189817 | A1 | 6/2021 | Fripp et al. |
| 2021/0332659 | A1 | 10/2021 | Fripp et al. |
| 2021/0353037 | A1 | 11/2021 | Cote |
| 2022/0074221 | A1 | 3/2022 | Laimbeer et al. |

FOREIGN PATENT DOCUMENTS

| | | | |
|---|---|---|---|
| CA | 3085547 | A1 | 8/2019 |
| CN | 1708631 | A | 12/2005 |
| CN | 102027189 | A | 4/2011 |
| CN | 104583530 | A | 4/2015 |
| CN | 105422146 | A | 3/2016 |
| CN | 106522923 | A | 3/2017 |
| CN | 107148444 | A | 9/2017 |
| CN | 107250321 | A | 10/2017 |
| CN | 107532466 | A | 1/2018 |
| EP | 1067320 | A2 | 1/2001 |
| EP | 2399000 | A2 | 12/2011 |
| EP | 2217790 | B1 | 10/2016 |
| EP | 2753791 | B1 | 6/2017 |
| FR | 3073549 | A1 | 5/2019 |
| GB | 2381278 | A | 4/2003 |
| GB | 2416796 | A | 2/2006 |
| GB | 2469723 | A | 10/2010 |
| GB | 2514195 | B | 6/2019 |
| GB | 2583232 | A | 10/2020 |
| GB | 2557397 | B | 8/2021 |
| GB | 2600258 | B | 3/2023 |
| MX | 2011008597 | A | 9/2011 |
| RU | 2424419 | C1 | 7/2011 |
| RU | 2588501 | C2 | 6/2016 |
| RU | 182236 | U1 | 8/2018 |
| WO | 0026501 | A1 | 5/2000 |
| WO | 2008079486 | A1 | 7/2008 |
| WO | 2010096417 | A2 | 8/2010 |
| WO | 2012090056 | A2 | 7/2012 |
| WO | 2013033208 | A1 | 3/2013 |
| WO | 2014098885 | A1 | 6/2014 |
| WO | 2014110382 | A1 | 7/2014 |
| WO | 2014210283 | A1 | 12/2014 |
| WO | 2016081287 | A1 | 5/2016 |
| WO | 2016171666 | A1 | 10/2016 |
| WO | 2018005740 | A1 | 1/2018 |
| WO | 2018057361 | A1 | 3/2018 |
| WO | 2018085102 | A1 | 5/2018 |
| WO | 2018102196 | A1 | 6/2018 |
| WO | 2018147833 | A1 | 8/2018 |
| WO | 2019094044 | A1 | 5/2019 |
| WO | 2019147285 | A1 | 8/2019 |
| WO | 2019164492 | A1 | 8/2019 |
| WO | 2019164499 | A1 | 8/2019 |
| WO | 2020005252 | A1 | 1/2020 |
| WO | 2020018110 | A1 | 1/2020 |
| WO | 2020068037 | A1 | 4/2020 |
| WO | 2021021203 | A1 | 2/2021 |
| WO | 2021034325 | A1 | 2/2021 |
| WO | 2021076141 | A1 | 4/2021 |
| WO | 2021173161 | A1 | 9/2021 |

OTHER PUBLICATIONS

Search Report in FR Application No. 1859379, dated Oct. 15, 2019.
International Search Report and Written Opinion dated Nov. 19, 2018; International PCT Application No. PCT/US2018/019337.
Denmark Examination Report and Search Report dated Mar. 16, 2021, Denmark Application No. PA202070389.
International Search Report and Written Opinion dated Jul. 8, 2020, issued in related International Application No. PCT/US2019/056814.
International Search Report and Written Opinion for corresponding PCT International Application No. PCT/US2019/068497; dated Sep. 17, 2020.
International Search report and Written Opinion for corresponding International Patent Application No. PCT/US2019/062225, dated Aug. 11, 2020.
International Search report and Written Opinion issued in related PCT/US2019/068493 dated Sep. 15, 2020.
NEMISIS Annulus Swellable Packer, Weatherford, Swellable Products, 2009-2011.
International Search Report and Written Opinion dated Nov. 22, 2019; International PCT Application No. PCT/US2019/019210.
International Search Report and Witten Opinion dated May 20, 2020, issued in related PCT/US2019/047529.
Tao, Solid expandable tubular patching technique for high-temperature and high-pressure casing damaged wells, Research Paper, Jun. 2015, pp. 408-409, Petroleum Exploration and Development, vol. 42, Issue 3.
Dutch Search Report issued in NL 2026726, dated Aug. 13, 2021.
International Search Report and Written Opinion dated Sep. 8, 2021 in PCT/US2020/066193.
Search Report and Written Opinion issued in NL2026329, dated Aug. 13, 2021.
Written Opinion and Search Report in SG Appln No. 11202000316S, dated Aug. 30, 2021.
Dutch Search Report in NL Appln No. 2026737, dated Aug. 13, 2021.
Examination Report in GCC Appln No. GC 2020-39914, dated Jul. 29, 2021.
Office Action in CA Appln No. 3,070,929, dated Jul. 9, 2021.
International Search Report & Written Opinion in PCT/US2019/042074 dated Apr. 10, 2020.
Search Report in NL Appln No. 2025837, dated Sep. 23, 2021.
Office Action in CA Application No. 3,070,929 dated Nov. 19, 2021.
International Search Report & Written Opinion in PCT/US2019/017538, dated Nov. 11, 2019.
Chinese Search Report dated Dec. 17, 2021; CN Application No. 2018800875885.
Examination Report in GB Appln No. 2010931.0 dated Jan. 18, 2022.
International Search Report & Written Opinion in PCT/US2020/065539, dated Aug. 30, 2021.
International Search Report & Written Opinion in PCT/US2019/058904, dated Jul. 23, 2020.
Netherlands Search Report in Application No. 2025954, dated Mar. 2, 2021.
International Search Report and Written Opinion in PCT/US2019/044542, dated Apr. 28, 2020.

(56) References Cited

OTHER PUBLICATIONS

Examination Report in GCC Application No. GC 2020-40201, dated Aug. 31, 2021.
French Search Report issued in FR Appln No. FR2006166, dated May 30, 2022.
International Search Report & Written Opinion in PCT/US2021/048628 dated May 19, 2022.
International Search Report & Written Opinion in PCT/US2021/027245 dated Jan. 10, 2022.
International Search Report and Written Opinion in PCT/US2021/032983, dated Feb. 10, 2022.
Netherlands Search Report in Application No. 2026573 dated Aug. 20, 2021.
Russian Office Action in RU Application No. 2021121198, dated Nov. 25, 2021.
GC Examination Report in GC Application No. 2019-38908, dated Nov. 4, 2020.
GC Examination Report in GC Application No. 2020-40475, dated Nov. 25, 2021.
MY Search Report in MY Application No. PI2020003430, dated May 26, 2022.
GB Examination Report in Application No. 2010931.0 dated Apr. 5, 2022.
DK Examination Report in Application No. PA 202070389, dated Oct. 20, 2021.
International Preliminary Report on Patentability in PCT/US2019/068493, dated Jun. 30, 2022.
International Preliminary Report on Patentability in PCT/US2019/068497, dated Jun. 30, 2022.
Search Report in NL Application No. 2032583 dated Aug. 31, 2023.
Examination Report in GB Application No. GB2205332.6, dated Sep. 7, 2023.
International Preliminary Report on Patentability in PCT/US2019/019210, dated Aug. 24, 2021.
International Preliminary Report on Patentability in PCT/US2019/058904, dated May 3, 2022.
International Preliminary Report on Patentability in PCT/US2019/056814, dated Apr. 19, 2022.
Fripp, Novel Expanding Metal Alloy for Non-Elastomeric Sealing and Anchoring, Research Paper, Oct. 3, 2022, 8 pages, Society of Petroleum Engineers, SPE-210273-MS.
First Examination Report in SA Application No. 522441072 dated May 29, 2023.
International Search Report and Written Opinion dated Feb. 10, 2021; International Application No. PCT/US2020/034887.
Written Opinion & Search Report in SG Application No. 11202112174W, dated Jul. 24, 2023.
Office Action in GB Application No. 2213658.4 dated Oct. 5, 2023.
Office Action & Search Report in CN Application No. 201980102182.4 dated Sep. 12, 2023.
Office Action in AR Application No. 20200101954, dated Oct. 4, 2023.
Office Action dated Nov. 15, 2023 for DE Patent Application No. 112019007811.9.
Office Action dated Nov. 17, 2023 for U.S. Appl. No. 16/964,430.

* cited by examiner

REACTIVE METAL FOR CEMENT ASSURANCE

TECHNICAL FIELD

The present disclosure relates to the use of a reactive metal element, and more particularly, to the use of a reactive metal element for improving zonal isolation in cementing operations.

BACKGROUND

In a cementing operation, a conduit is cemented into place in a wellbore. The conduit may be cemented within another conduit or within the walls of the subterranean formation. The cementing operation provides zonal isolation by sealing off a wellbore or formation zone, thereby isolating the cemented portion from the wellbore and/or conduit.

In some cementing operations, cement assurance issues may arise due to a lack of homogenous distribution across the intended interval. Additionally, the conduit may not lay perfectly centered within the wellbore and may lay proximate to a formation wall. In such an operation, the cement sheath may be thinner where the conduit is proximate the formation. This could create issues where the cement is not able to fully displace the previous fluid and thus cannot create a homogenous and filled cross-section. Moreover, a thin cement layer increases the risk of cement failure. Another issue is that some wellbore operations may degrade cement protection over time and induce the formation of microannuli or cracks. Once the cement has set, the cement can no longer flow or expand to fill in voids, nor can it repair cracks that may form. The present disclosure provides improved apparatus and methods for providing cement assurance in cementing operations.

BRIEF DESCRIPTION OF THE DRAWINGS

Illustrative examples of the present disclosure are described in detail below with reference to the attached drawing figures, which are incorporated by reference herein, and wherein.

Figure 1:
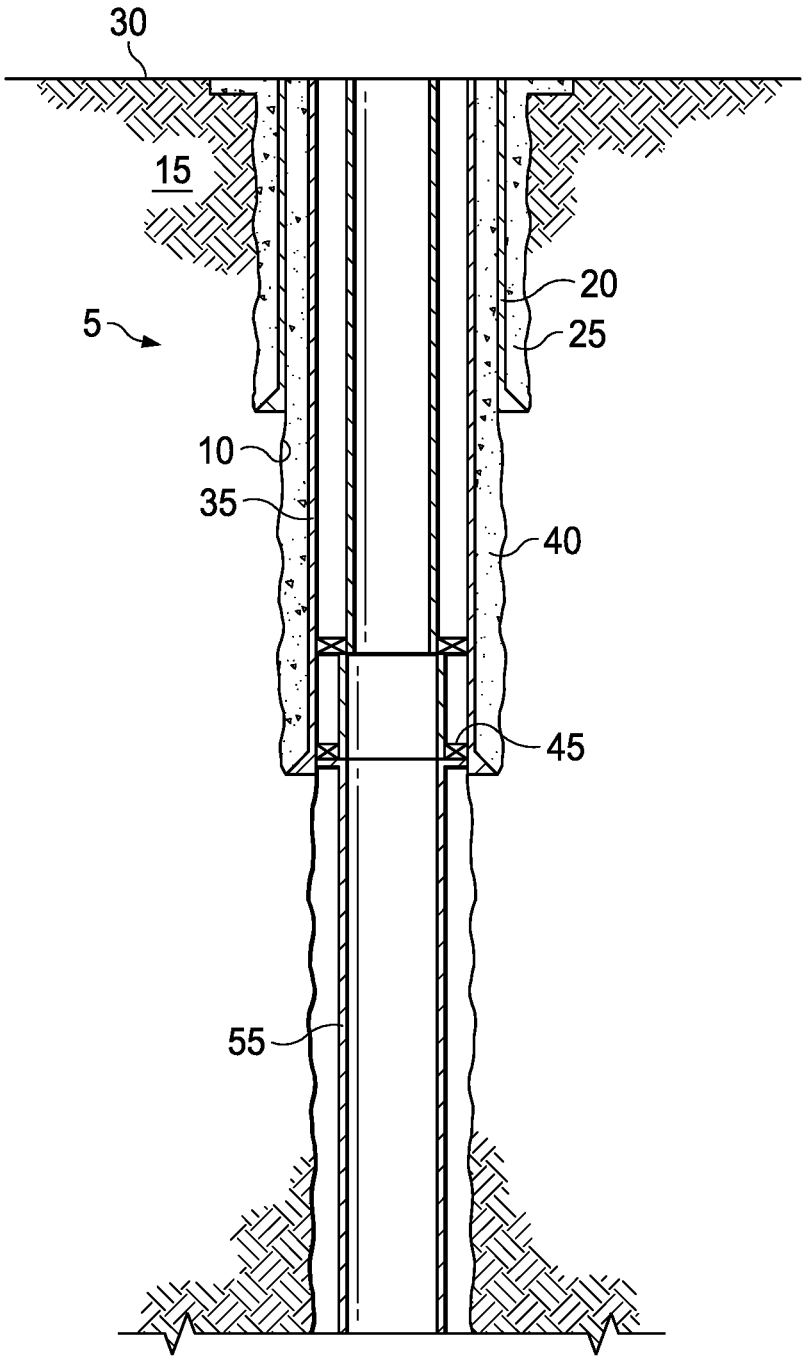
FIG. 1 is a cross-section of an example conduit system for a wellbore penetrating a subterranean formation in accordance with the examples disclosed herein.

The illustrated figures are only exemplary and are not intended to assert or imply any limitation with regard to the environment, architecture, design, or process in which different examples may be implemented.

DETAILED DESCRIPTION

The present disclosure relates to the use of a reactive metal element, and more particularly, to the use of a reactive metal element for improving zonal isolation in cementing operations.

In the following detailed description of several illustrative examples, reference is made to the accompanying drawings that form a part hereof, and in which is shown by way of illustration examples that may be practiced. These examples are described in sufficient detail to enable those skilled in the art to practice them, and it is to be understood that other examples may be utilized, and that logical structural, mechanical, electrical, and chemical changes may be made without departing from the spirit or scope of the disclosed examples. To avoid detail not necessary to enable those skilled in the art to practice the examples described herein, the description may omit certain information known to those skilled in the art. The following detailed description is, therefore, not to be taken in a limiting sense, and the scope of the illustrative examples is defined only by the appended claims.

Unless otherwise indicated, all numbers expressing quantities of ingredients, properties such as molecular weight, reaction conditions, and so forth used in the present specification and associated claims are to be understood as being modified in all instances by the term "about." Accordingly, unless indicated to the contrary, the numerical parameters set forth in the following specification and attached claims are approximations that may vary depending upon the desired properties sought to be obtained by the examples of the present disclosure. At the very least, and not as an attempt to limit the application of the doctrine of equivalents to the scope of the claim, each numerical parameter should at least be construed in light of the number of reported significant digits and by applying ordinary rounding techniques. It should be noted that when "about" is at the beginning of a numerical list, "about" modifies each number of the numerical list. Further, in some numerical listings of ranges some lower limits listed may be greater than some upper limits listed. One skilled in the art will recognize that the selected subset will require the selection of an upper limit in excess of the selected lower limit.

Unless otherwise specified, any use of any form of the terms "connect," "engage," "couple," "attach," or any other term describing an interaction between elements is not meant to limit the interaction to direct interaction between the elements and may also include indirect interaction between the elements described. Further, any use of any form of the terms "connect," "engage," "couple," "attach," or any other term describing an interaction between elements includes items integrally formed together without the aid of extraneous fasteners or joining devices. In the following discussion and in the claims, the terms "including" and "comprising" are used in an open-ended fashion, and thus should be interpreted to mean "including, but not limited to." Unless otherwise indicated, as used throughout this document, "or" does not require mutual exclusivity.

The terms uphole and downhole may be used to refer to the location of various components relative to the bottom or end of a well. For example, a first component described as uphole from a second component may be further away from the end of the well than the second component. Similarly, a first component described as being downhole from a second component may be located closer to the end of the well than the second component.

Examples of the methods and systems described herein relate to the use of a reactive metal element, and more particularly, to the use of a reactive metal element for improving zonal isolation in cementing operations. The reactive metal element comprises a reactive metal which, after reaction, provides an expansion of its metal to fill voids in the surrounding cement sheath. The reactive metal provides this expansion after contacting a specific reaction-inducing fluid, such as a brine, where it produces a reaction product having a larger volume than the base reactive metal reactant. This increase in metal volume of the reaction product provides for an expansion of the metal reaction product into any adjacent void space, such as a void in the surrounding cement sheath. The reaction product solidifies to provide cement assurance for further wellbore operations. The formation of the reaction products results in the volumetric expansion of the reactive metal element allowing for an improvement in zonal isolation of the cement sheath. The solidified reaction products also improve the anchoring of the conduit surrounded by the cement sheath, securing it in the wellbore and allowing for secure suspension. Advantageously, the reactive metal elements may be used in a variety of wellbore applications where there are cement assurance concerns. Yet a further advantage is that the reactive metal elements provide expansion in high-salinity and/or high-temperature environments. An additional advantage is that the reactive metal elements comprise a wide variety of metals and metal alloys and react upon contact with reaction-inducing fluids, including a variety of wellbore fluids. The reactive metal elements may be used as replacements for other types of expandable elements (e.g., elastomeric elements), or they may be used in combination with other types of expandable elements. One other advantage is that in some examples, the reactive metal elements may be placed on existing conduits without impact to or adjustment of the conduit outer diameter or exterior profile to accommodate the reactive metal element. In some examples, the reactive metal elements are free of elastomeric materials and may be usable in wellbore environments where elastomeric materials may be prone to breakdown.

The reactive metals expand by undergoing a reaction in the presence of a reaction—inducing fluid (e.g., a brine) to form a reaction product (e.g., metal hydroxides). The resulting reaction products occupy more volumetric space relative to the base reactive metal reactant. This difference in volume allows the reactive metal element to expand to fill void space at the interface of the reactive metal element and any adjacent surfaces. It is to be understood that the use of the term "fill" does not necessarily mean a complete filling of the void space, and that the reaction product may partially fill the void space in some examples. Magnesium may be used to illustrate the volumetric expansion of the reactive metal as it undergoes reaction with the reaction-inducing fluid. A mole of magnesium has a molar mass of 24 g/mol and a density of 1.74 g/cm$^3$, resulting in a volume of 13.8 cm$^3$/mol. Magnesium hydroxide, the reaction product of magnesium and an aqueous reaction-inducing fluid, has a molar mass of 60 g/mol and a density of 2.34 g/cm$^3$, resulting in a volume of 25.6 cm$^3$/mol. The magnesium hydroxide volume of 25.6 cm$^3$/mol is an 85% increase in volume over the 13.8 cm$^3$/mol volume of the mole of magnesium. As another example, a mole of calcium has a molar mass of 40 g/mol and a density of 1.54 g/cm$^3$, resulting in a volume of 26.0 cm$^3$/mol. Calcium hydroxide, the reaction product of calcium and an aqueous reaction-inducing fluid, has a molar mass of 76 g/mol and a density of 2.21 g/cm$^3$, resulting in a volume of 34.4 cm$^3$/mol. The calcium hydroxide volume of 34.4 cm$^3$/mol is a 32% increase in volume over the 26.0 cm$^3$/mol volume of the mole of calcium. As yet another example, a mole of aluminum has a molar mass of 27 g/mol and a density of 2.7 g/cm$^3$, resulting in a volume of 10.0 cm$^3$/mol. Aluminum hydroxide, the reaction product of aluminum and an aqueous reaction-inducing fluid, has a molar mass of 63 g/mol and a density of 2.42 g/cm$^3$, resulting in a volume of 26 cm$^3$/mol. The aluminum hydroxide volume of 26 cm$^3$/mol is a 160% increase in volume over the 10 cm$^3$/mol volume of the mole of aluminum. The reactive metal may comprise any metal or metal alloy that undergoes a reaction to form a reaction product having a greater volume than the base reactive metal or alloy reactant.

The reactive metals undergo a chemical transformation whereby the metals chemically react with the reaction-inducing fluid, and upon reaction form a metal hydroxide that is the principal component of the expanded reactive metal element. The solidified metal hydroxide is larger in volume than the base reactive metal, allowing for expansion into the annular space around the reactive metal element (e.g., a void space in a surrounding cement sheath).

Examples of suitable metals for the reactive metal include, but are not limited to, magnesium, calcium, aluminum, tin, zinc, beryllium, barium, manganese, or any combination thereof. Preferred metals include magnesium, calcium, and aluminum.

Examples of suitable metal alloys for the reactive metal include, but are not limited to, alloys of magnesium, calcium, aluminum, tin, zinc, beryllium, barium, manganese, or any combination thereof. Preferred metal alloys include alloys of magnesium-zinc, magnesium-aluminum, calcium-magnesium, or aluminum-copper. In some examples, the metal alloys may comprise alloyed elements that are not metallic. Examples of these non-metallic elements include, but are not limited to, graphite, carbon, silicon, boron nitride, and the like. In some examples, the metal is alloyed to increase reactivity and/or to control the formation of oxides.

In some examples, the metal alloy is also alloyed with a dopant metal that promotes corrosion or inhibits passivation and thus increases hydroxide formation. Examples of dopant metals include, but are not limited to, nickel, iron, copper, carbon, titanium, gallium, mercury, cobalt, iridium, gold, palladium, or any combination thereof.

In some examples, the reactive metal comprises an oxide. As an example, calcium oxide reacts with water in an energetic reaction to produce calcium hydroxide. One mole of calcium oxide occupies 9.5 cm$^3$ whereas one mole of calcium hydroxide occupies 34.4 cm$^3$. This is a 260% volumetric expansion of the mole of calcium oxide relative to the mole of calcium hydroxide. Examples of metal oxides suitable for the reactive metal may include, but are not limited to, oxides of any metals disclosed herein, including magnesium, calcium, aluminum, iron, nickel, copper, chromium, tin, zinc, lead, beryllium, barium, gallium, indium, bismuth, titanium, manganese, cobalt, or any combination thereof.

It is to be understood that the selected reactive metal is chosen such that the formed reaction product does not dissolve or otherwise degrade in the reaction-inducing fluid in a manner that prevents its solidification in a void space. As such, the use of metals or metal alloys for the reactive metal that form relatively insoluble reaction products in the reaction-inducing fluid may be preferred. As an example, the magnesium hydroxide and calcium hydroxide reaction products have very low solubility in water. As an alternative or an addition, the reactive metal element may be positioned and configured in a way that constrains the degradation of the reactive metal element in the reaction-inducing fluid due to the geometry of the area in which the reactive metal element is disposed. This may result in reduced exposure of the reactive metal element to the reaction-inducing fluid, but may also reduce degradation of the reaction product of the reactive metal element, thereby prolonging the life of the reaction product in the void space. As an example, the volume of the area in which the reactive metal element is disposed may be less than the potential expansion volume of the volume of reactive metal disposed in said area. In some examples, this volume of area may be less than as much as 50% of the expansion volume of reactive metal. Alternatively, this volume of area may be less than 90% of the expansion volume of reactive metal. As another alternative, this volume of area may be less than 80% of the expansion volume of reactive metal. As another alternative, this volume of area may be less than 70% of the expansion volume of reactive metal. As another alternative, this volume of area may be less than 60% of the expansion volume of reactive metal. In a specific example, a portion of the reactive metal element may be disposed in a recess within the conduit to restrict the exposure area to only the surface portion of the reactive metal element that is not disposed in the recess.

In some examples, the formed reaction products of the reactive metal reaction may be dehydrated under sufficient pressure. For example, if a metal hydroxide is under sufficient contact pressure and resists further movement induced by additional hydroxide formation, the elevated pressure may induce dehydration of the metal hydroxide to form the metal oxide. As an example, magnesium hydroxide may be dehydrated under sufficient pressure to form magnesium oxide and water. As another example, calcium hydroxide may be dehydrated under sufficient pressure to form calcium oxide and water. As yet another example, aluminum hydroxide may be dehydrated under sufficient pressure to form aluminum oxide and water.

The reactive metal elements may be formed in a solid solution process, a powder metallurgy process, or through any other method as would be apparent to one of ordinary skill in the art. Regardless of the method of manufacture, the reactive metal elements may be slipped over the conduit and held in place via any sufficient method. The reactive metal elements may be placed over the conduit in one solid piece or in multiple discrete pieces. Once in place, the reactive metal element may be held in position with end rings, stamped rings, retaining rings, fasteners, adhesives, set screws, swedging, or any other such method for retaining the reactive metal element in position. In some alternative examples, the reactive metal element may not be held in position and may slide freely on the exterior of the tubular. As discussed above, the reactive metal elements may be formed and shaped to fit over existing conduits and may not require modification of the outer diameter or profile of the liner hanger in some examples. Alternatively, the conduit may be manufactured to comprise a recess in which the reactive metal element may be disposed. The recess may be of sufficient dimensions and geometry to retain the reactive metal elements in the recess. In alternative examples, the reactive metal element may be cast onto the conduit. In some alternative examples, the diameter of the reactive metal element may be reduced (e.g., by swaging) when disposed on the conduit. In some examples, the reactive metal elements may be disposed over the length of the conduit (e.g., the singular conduit joint of the conduit string that is threaded or coupled to other conduit joints to form a conduit string). In alternative examples, the reactive metal element may be placed on only a portion of the conduit joint. In some examples, the reactive metal elements may be placed on all conduit joints to form continuous covering of the conduit string. In other examples, the reactive metal elements may be placed on only some of the conduit joints of the conduit string (e.g., at locations where cement assurance issues may occur).

In some optional examples, the reactive metal element may include a removable barrier coating. The removable barrier coating may be used to cover the exterior surfaces of the reactive metal element and prevent contact of the reactive metal with the reaction-inducing fluid. The removable barrier coating may be removed after the cementing operation has completed. The removable barrier coating may be used to delay reaction and/or prevent premature expansion with the reactive metal element. Examples of the removable barrier coating include, but are not limited to, any species of plastic shell, organic shell, paint, dissolvable coatings (e.g., solid magnesium compounds or an aliphatic polyester), a meltable material (e.g., with a melting temperature less than 550° F.), or any combination thereof. When desired, the removable barrier coating may be removed from the reactive metal element with any sufficient method. For example, the removable barrier coating may be removed through dissolution, a phase change induced by changing temperature, corrosion, hydrolysis, melting, or the removable barrier coating may be time-delayed and degrade after a desired time under specific wellbore conditions.

In some optional examples, the reactive metal element may include an additive which may be added to the reactive metal element during manufacture as a part of the composition, or the additive may be coated onto the reactive metal element after manufacturing. The additive may alter one or more properties of the reactive metal element. For example, the additive may improve expansion, add texturing, improve bonding, improve gripping, etc. Examples of the additive include, but are not limited to, any species of ceramic, elastomer, glass, non-reacting metal, the like, or any combination.

The reactive metal element may be used to expand into any void spaces that are proximate to the reactive metal elements. Without limitation, the reactive metal elements may be used to fill any voids in the cement sheath, which may include cracks which form in the set cement, channels formed from gas channeling through cement as it sets, microannuli formed between the cement sheath and the conduit which may be formed from temperature cycling, stress load cycling, conduit shrinkage, etc.

As described above, the reactive metal elements comprise reactive metals and as such, they are non-elastomeric materials. As non-elastomeric materials, the reactive metal elements do not possess elasticity, and therefore, they may irreversibly expand when contacted with a reaction-inducing fluid. The reactive metal elements may not return to their original size or shape even after the reaction-inducing fluid is removed from contact.

Generally, the reaction-inducing fluid induces a reaction in the reactive metal to form a reaction product that occupies more space than the unreacted reactive metal. Examples of the reaction-inducing fluid include, but are not limited to, saltwater (e.g., water containing one or more salts dissolved therein), brine (e.g., saturated saltwater, which may be produced from subterranean formations), seawater, or any combination thereof. Generally, the reaction-inducing fluid may be from any source provided that the fluid does not contain an excess of compounds that may undesirably affect other components in the sealing element. In the case of saltwater, brines, and seawater, the reaction-inducing fluid may comprise a monovalent salt or a divalent salt. Suitable monovalent salts may include, for example, sodium chloride salt, sodium bromide salt, potassium chloride salt, potassium bromide salt, and the like. Suitable divalent salt can include, for example, magnesium chloride salt, calcium chloride salt, calcium bromide salt, and the like. In some examples, the salinity of the reaction-inducing fluid may exceed 10%. Advantageously, the reactive metal elements of the present disclosure may not be impacted by contact with high-salinity fluids. One of ordinary skill in the art, with the benefit of this disclosure, should be readily able to select a reaction-inducing fluid for inducing a reaction with the reactive metal elements.

The reactive metal elements may be used in high-temperature formations (e.g., in formations with zones having temperatures equal to or exceeding 350° F.). Advantageously, the use of the reactive metal elements of the present disclosure may not be impacted in high-temperature formations. In some examples, the reactive metal elements may be used in both high-temperature formations and with high-salinity fluids. In a specific example, a reactive metal element may be positioned on a conduit and used to fill a void in a cement sheath after contact with a brine having a salinity of 10% or greater while also being disposed in a wellbore zone having a temperature equal to or exceeding 350° F.

FIG. 1 is a cross-section of an example conduit system, generally 5, for a wellbore 10 penetrating a subterranean formation 15. The conduit system 5 comprises a surface casing 20 and a surface cement sheath 25 descending from a surface 30. The conduit system 5 further comprises an intermediate casing 35 and intermediate cement sheath 40 deployed and nested concentrically within the surface casing 20. Although only one layer of intermediate casing 35 is illustrated, it is to be understood that more than one layer of intermediate casing 35 may be deployed in any example. A liner hanger 45 is deployed within the intermediate casing 35. The liner hanger 45 may be used to suspend a liner 55 from within the intermediate casing 35. The liner 55 may be any conduit suitable for suspension within the wellbore 10. In the example conduit system 5, a reactive metal element (illustrated in subsequent figures) may be deployed on the exterior of any conduit cemented into place. In this specific example, those conduits would be the surface casing 20 and the intermediate casing 35. The surface cement sheath 25 and the intermediate cement sheath 40 comprise cement that has been circulated over the exterior of the surface casing 20 and the intermediate casing 35. The circulated cement would necessarily also circulate over any reactive metal elements that would be present. Upon contact with a reaction-inducing fluid, the reactive metals within the reactive metal element will react to form the reaction product, thereby providing a filling expansion into any void space contactable by the reaction product to reinforce and support the surrounding cement sheaths 25 and 40.

Figure 2:
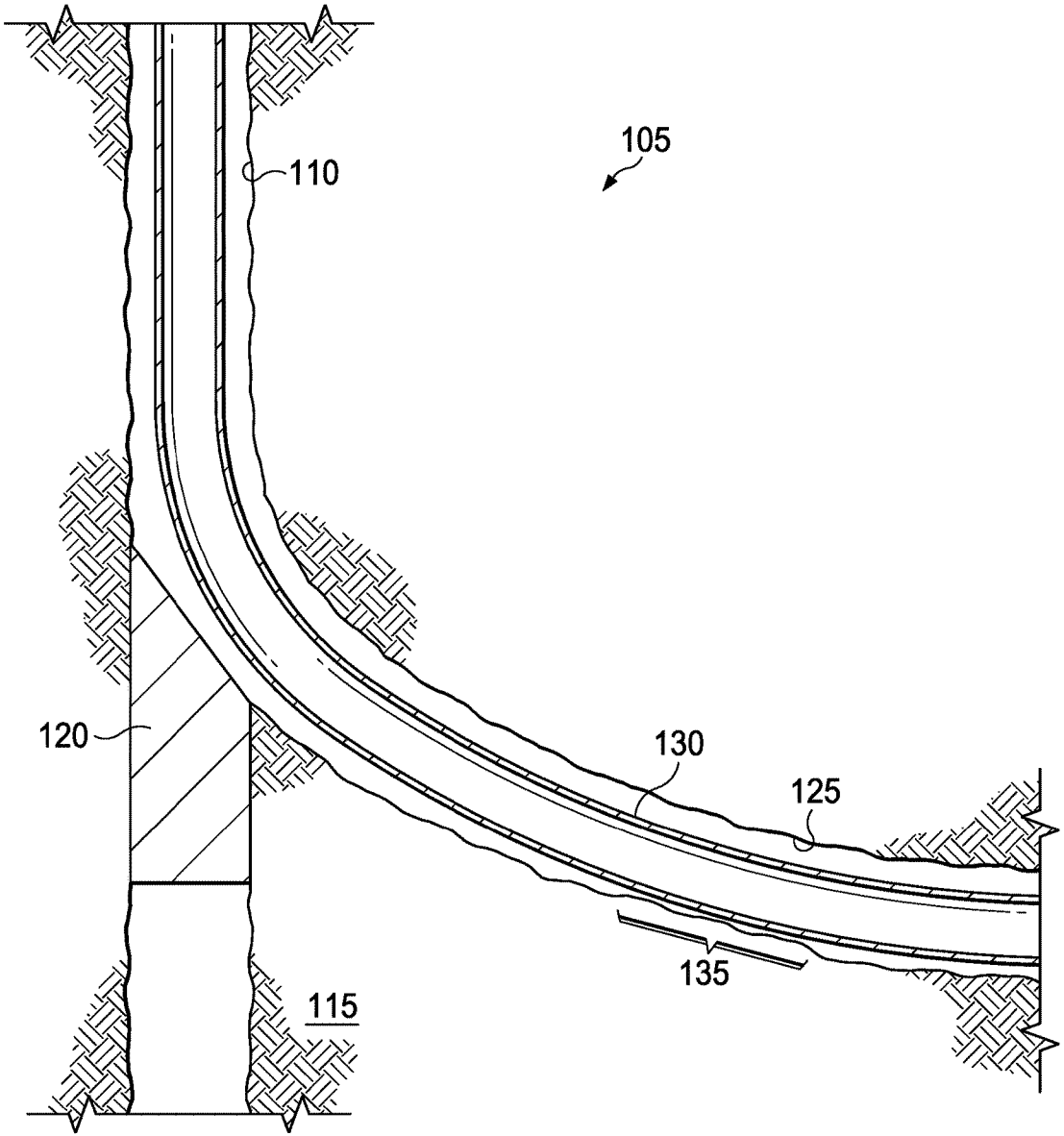
FIG. 2 is a cross-section of another example conduit system for a primary wellbore penetrating a subterranean formation in accordance with the examples disclosed herein.

FIG. 2 is a cross-section of another example conduit system, generally 105, for a primary wellbore 110 penetrating a subterranean formation 115. A deflector 120 has been positioned in primary wellbore 110 to allow the drilling of lateral wellbore 125. Lateral casing 130 has been positioned in lateral wellbore 125. Due to the nature of lateral wellbores 125, the lateral casing 130 may not be positioned exactly concentrically within the lateral wellbore 125 which may create a shallow area 135. Once cemented, the shallow area 135 is the location of the thinnest part of the cement sheath. In order to overcome cement assurance issues, a reactive metal element (illustrated in subsequent figures) may be placed over the lateral casing 130 at the location of the shallow area 135. Upon contact with a reaction-inducing fluid, the reactive metals within the reactive metal element will react to form the reaction product, thereby providing a filling expansion into any void space contactable by the reaction product to reinforce and support the surrounding cement sheath that would cover the shallow area 135.

Figure 3:
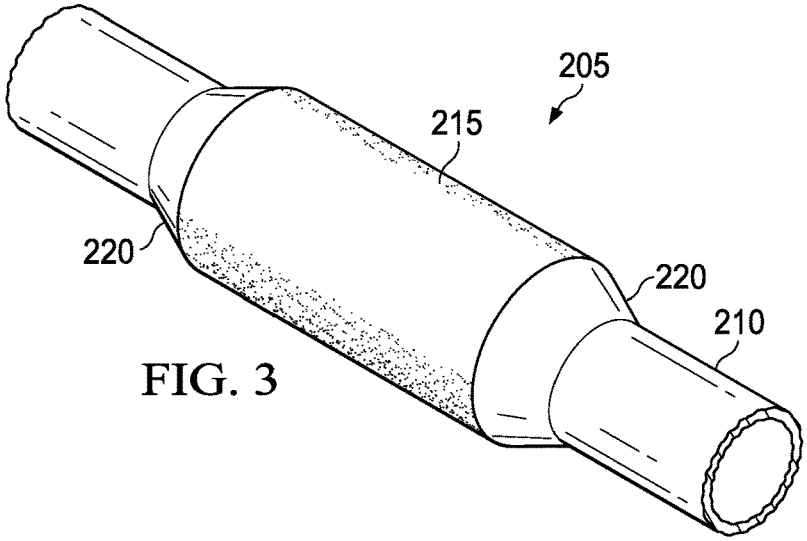
FIG. 3 is a perspective illustration of an example reactive metal element disposed on a conduit in accordance with the examples disclosed herein.

FIG. 3 is a perspective illustration of an example reactive metal element, generally 205, disposed on a conduit 210. The reactive metal element 205 comprises a reactive metal 215 as disclosed and described herein. The reactive metal element 205 is wrapped or slipped on the conduit 210 with weight, grade, and connection specified by the well design. The conduit 210 may be any type of conduit used in a wellbore, including drill pipe, stick pipe, tubing, coiled tubing, etc. The reactive metal element 205 further comprises end rings 220. End rings 220 protect the reactive metal element 205 as it is run to depth. End rings 220 may create an extrusion barrier, preventing the applied pressure from extruding the reactive metal 215 in the direction of said applied pressure. In some examples, end rings 220 may comprise a reactive metal 215 and may thus serve a dual function. In some examples, end rings 220 may not comprise a reactive metal 215. Although FIG. 1 and some other examples illustrated herein may illustrate end rings 220 as a component of a reactive metal element, it is to be understood that end rings 220 are optional components in all examples described herein, and are not necessary for any reactive metal element to function as intended.

Figure 4:
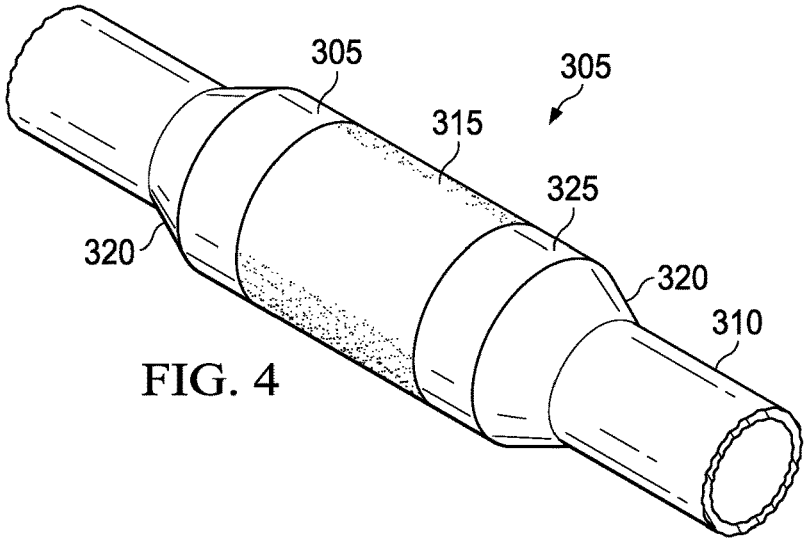
FIG. 4 is a perspective illustration of another example of a reactive metal element disposed on a conduit in accordance with the examples disclosed herein.

FIG. 4 is a perspective illustration of another example of a reactive metal element, generally 305, disposed on a conduit 310. The reactive metal element 305 comprises a reactive metal 315. The reactive metal element 305 is wrapped or slipped on the conduit 310 with weight, grade, and connection specified by the well design. The reactive metal element 305 further comprises optional end rings 320 as described in FIG. 3. Reactive metal element 305 further comprises two swellable non-metal elements 325 disposed adjacent to end rings 320 and the reactive metal 315.

Swellable non-metal elements 325 may comprise any oil-swellable, water-swellable, and/or combination swellable non-metal material as would occur to one of ordinary skill in the art. A specific example of a swellable non-metal material is a swellable elastomer. The swellable non-metal elements 325 may swell when exposed to a fluid that induces swelling (e.g., an oleaginous or aqueous fluid). Generally, the swellable non-metal elements 325 may swell through diffusion whereby the swelling-inducing fluid is absorbed into the swellable non-metal elements 325. This fluid may continue to diffuse into the swellable non-metal elements 325 causing the swellable non-metal elements 325 to swell until they contact an adjacent surface such as a cement. The swellable non-metal elements 325 may swell to fill a void in a cement sheath and work in tandem with the reactive metal 315 to provide expansion into a void space within a cement sheath surrounding the conduit 310.

Although FIG. 4 illustrates two swellable non-metal elements 325, it is to be understood that in some examples only one swellable non-metal element 325 may be provided, and the reactive metal 315 may be disposed adjacent to an end ring 320, or, alternatively, may comprise the end of the reactive metal element 305 should end rings 320 not be provided.

Further, although FIG. 4 illustrates two swellable non-metal elements 325 individually adjacent to one end of the reactive metal element 305, it is to be understood that in some examples, the orientation may be reversed, and the reactive metal element 305 may instead comprise two reactive metals 315 each individually disposed adjacent to an end ring 320 and also one terminal end of a swellable non-metal element 325.

Figure 5:
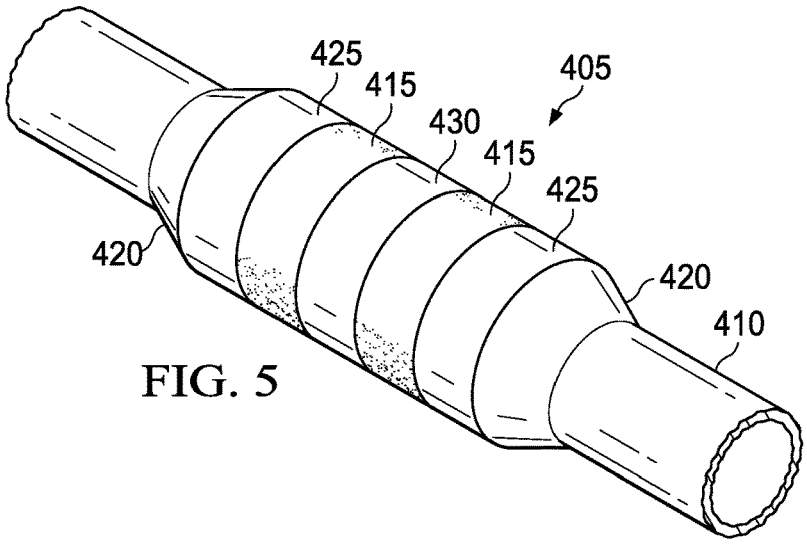
FIG. 5 is a perspective illustration of another example of a reactive metal element disposed on a conduit in accordance with the examples disclosed herein.

FIG. 5 is a perspective illustration of another example of a reactive metal element, generally 405, disposed on a conduit 410. The reactive metal element 405 comprises multiple reactive metals 415 and also multiple swellable non-metal elements 425 as described above. The reactive metal element 405 is wrapped or slipped on the conduit 410 with weight, grade, and connection specified by the well design. The reactive metal element 405 further comprises optional end rings 420 as described above. Reactive metal element 405 differs from the examples described in the FIGURES above, in that the reactive metal element 405 further comprises spacer element 430. Spacer element 430 may be a polymer-based material or a metal, such as steel. The spacer element 430 may provide additional anchoring support to the reactive metal element 405 within a fixed location or may space other components such as multiple reactive metals 415 and/or swellable non-metal elements 425.

It is to be understood that the reactive metal elements described herein may comprise any multiple of reactive metals, swellable non-metal elements, and spacer elements arranged in any desired manner. The reactive metals, swellable non-metal elements, and spacer elements may be placed in any pattern or configuration, either by themselves or in conjunction with other elements and components, such as other species of reactive metals, swellable non-metal elements, and spacer elements. As an example, a single reactive metal may be used. As another example, multiple reactive metals may be used. As a further example, multiple reactive metals may be used in a series adjacent to one another with individual other species of spacer elements and/or swellable non-metal elements placed at any point of the series. In some examples, multiple other species of spacer elements may be placed at the ends of the series. As another example, multiple reactive metals may alternate in the series with other species of spacer elements and/or swellable non-metal elements. In some additional examples, the spacer elements may be placed on the conduit in a location that is not proximate to the reactive metals. For example, the spacer elements may be placed on the opposing side of a retaining element or pair of retaining elements such as cup seals, end rings, stamped rings, etc. which may have a reactive metal or series of reactive metal disposed on the other side or therebetween. In some examples, the reactive metals may comprise different species of reactive metals, allowing the reactive metal element to be custom configured to the well as desired.

Figure 6:
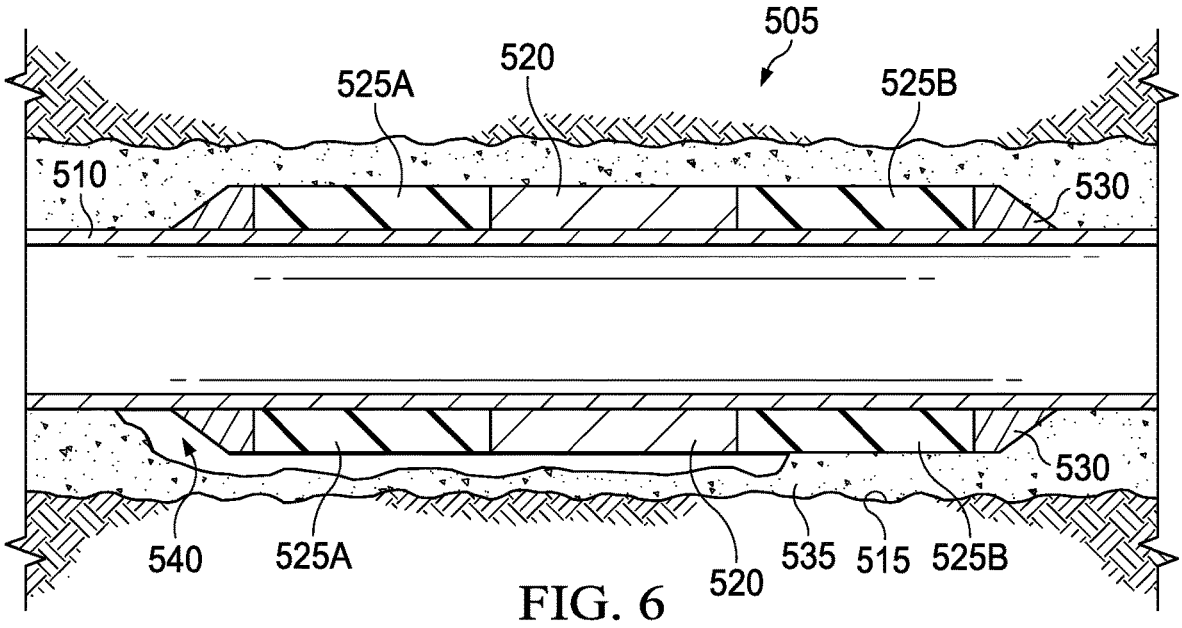
FIG. 6 is a perspective illustration of another example of a reactive metal element as it is disposed on a conduit in accordance with the examples disclosed herein.

FIG. 6 is a perspective illustration of another example of a reactive metal element, generally 505, as it is disposed on a conduit 510. Conduit 510 is a surface conduit disposed in an open-hole wellbore 515. Reactive metal 520 is disposed generally in the center of the reactive metal element 505. Two swellable non-metal elements 525 are positioned on either side of the reactive metal 520. Swellable non-metal element 525A is an oil-swelling non-metal element that may swell when contacted with an oleaginous fluid. Swellable non-metal element 525B is a water-swelling non-metal element that may swell when contacted with an aqueous fluid. As illustrated, optional end rings 530 may protect the reactive metal element 505 from abrasion as it is run in hole. As discussed above, different arrangements and species of reactive metals, swellable non-metal elements, and spacer elements may be utilized in the reactive metal elements as desired. Cement sheath 535 surrounds the conduit 510 to cement it in place. A void 540 has formed in the cement sheath 535. Upon contact with a reaction inducing fluid, the reactive metal 520 reacts to form a reaction product that provides expansion into the void 540 to reinforce the cement sheath 535 and provide cement assurance and improved zonal isolation. The two swellable non-metal elements 525 work in tandem with the reactive metal 520 to provide expansion in the void 540 upon contact with their respective swell-inducing fluid.

Figure 7:
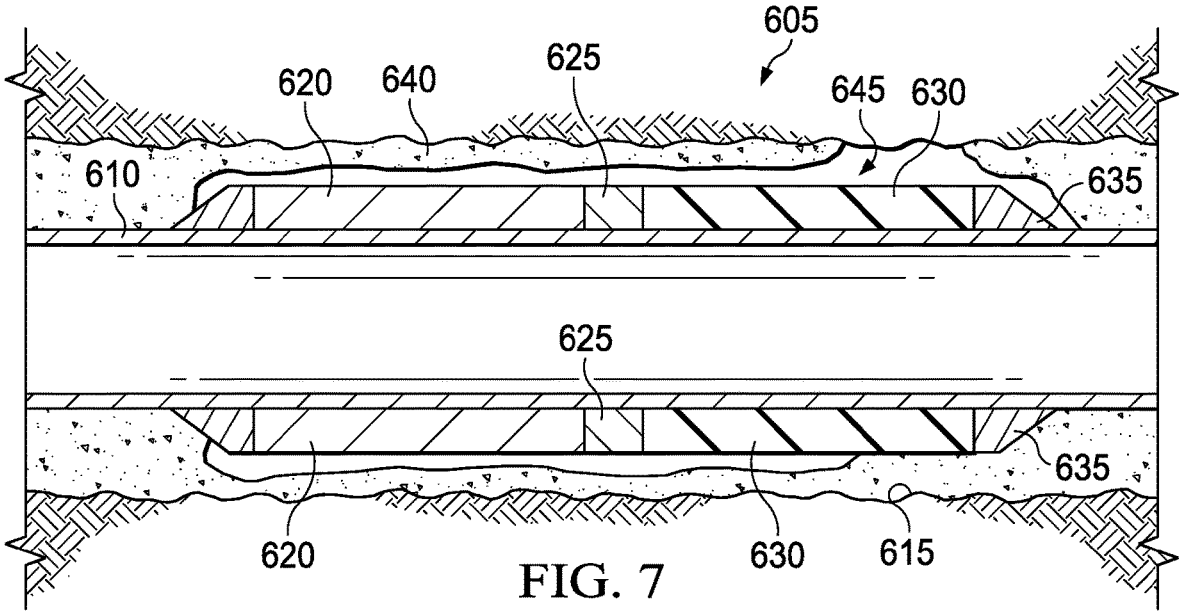
FIG. 7 is a perspective illustration of another example of a reactive metal element as it is disposed on a conduit in accordance with the examples disclosed herein.

FIG. 7 is a perspective illustration of another example of a reactive metal element, generally 605, as it is disposed on a conduit 610. Conduit 610 is a surface conduit disposed in an open-hole wellbore 615. Reactive metal 620 is disposed on one side of a spacer element 625 as described above. A swellable non-metal element 630 is disposed on the opposing side of the spacer element 625. As illustrated, optional end rings 635 may protect the reactive metal element 605 from abrasion as it is run in hole. As discussed above, different arrangements and species of reactive metals, swellable non-metal elements, and spacer elements may be utilized in the reactive metal elements as desired. Cement sheath 640 surrounds the conduit 610 to cement it in place. A void 645 has formed in the cement sheath 640. Upon contact with a reaction inducing fluid, the reactive metal 620 reacts to form a reaction product that provides expansion into the void 645 to reinforce the cement sheath 640 and provide cement assurance and improved zonal isolation. The swellable non-metal element 630 works in tandem with the reactive metal 620 to provide expansion in the void 645 upon contact with a swell-inducing fluid.

Figure 8:
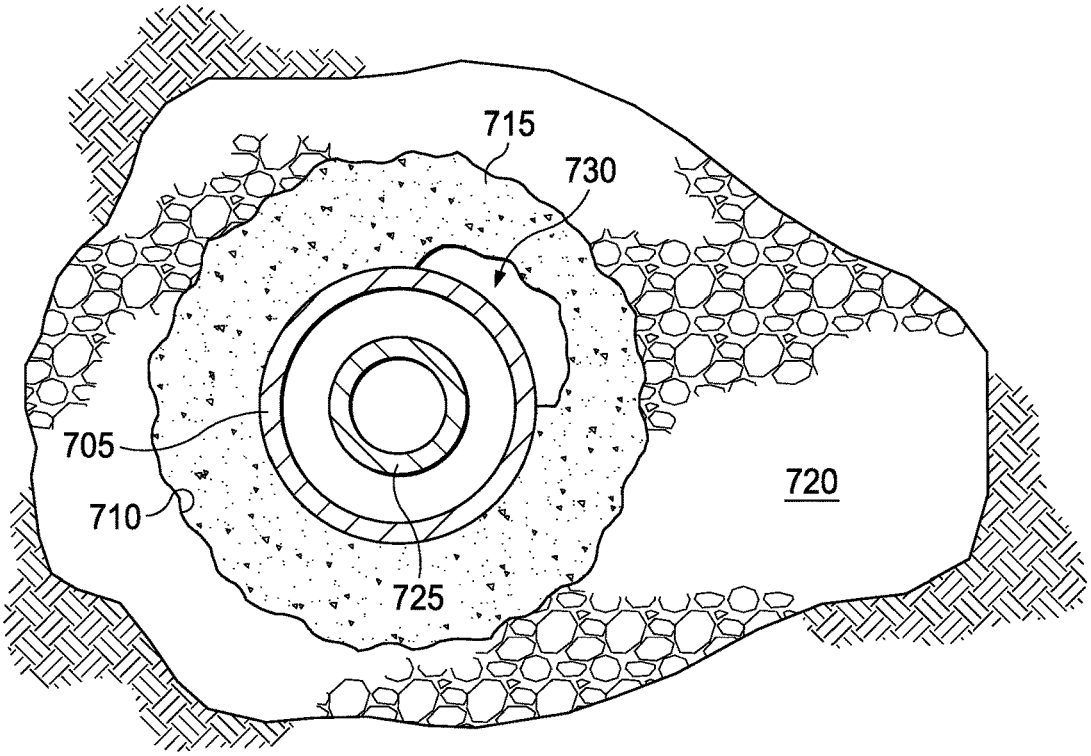
FIG. 8 is a cross-section illustration of a void in a surface cement sheath in accordance with the examples disclosed herein.

FIG. 8 is a cross-section illustration of a void in a cement sheath. Surface conduit 705 is deployed in a wellbore 710 that is disposed in a subterranean formation 720. Surface conduit 705 has been cemented into place with surface cement sheath 715. An intermediate conduit 725 resides concentrically within surface conduit 705 and may be cemented into place in a subsequent cement operation. A void 730 has formed in the surface cement sheath 715. The void 730 weakens the supporting surface cement sheath 715 at the location adjacent to the void 730 where the surface cement sheath 715 is thinner than the remaining portion of the surface cement sheath 715. This weakened area in the surface cement sheath 715 may create cement assurance issues.

Figure 9:
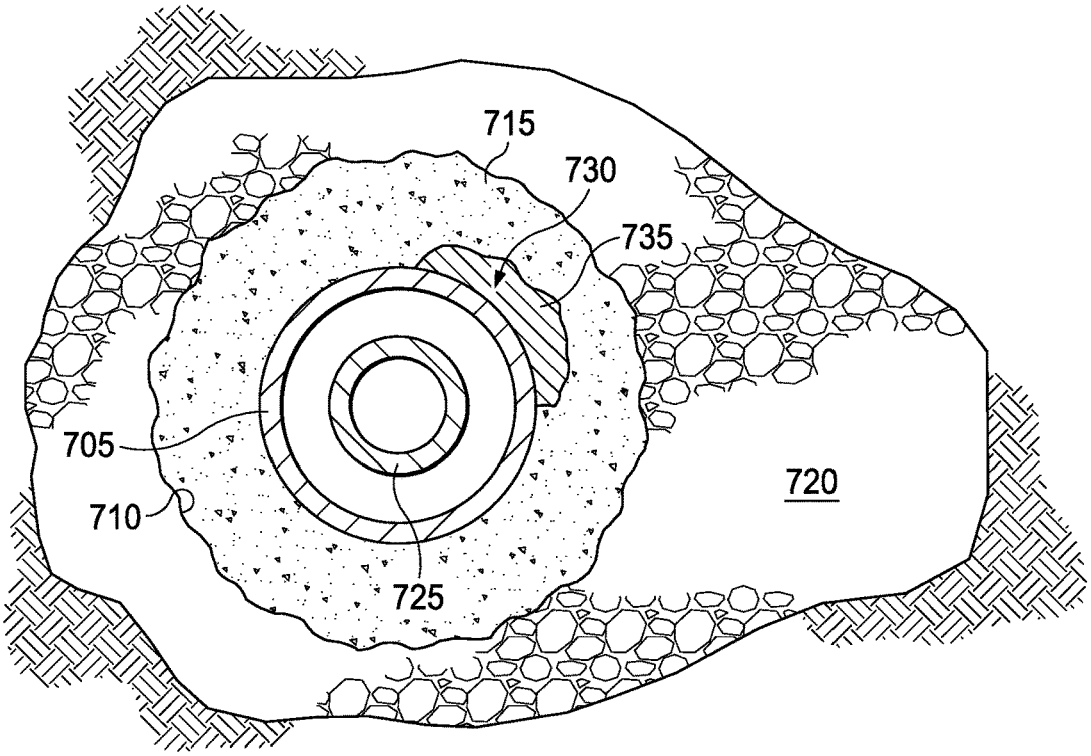
FIG. 9 is a cross-section illustrating the surface cement sheath of FIG. 8 after the void has been filled in accordance with the examples disclosed herein.

FIG. 9 is a cross-section illustrating the surface cement sheath 715 of FIG. 8 after the void 730 has been filled. A reactive metal element placed proximate the void 730 allows for the reactive metal to react and fill the void 730 with a reaction product 735 as shown. The reaction product 735 is formed from the reaction of the reactive metal and a reaction-inducing fluid. The reaction product 735 provides expansion into the surrounding void 730, at least partially filling it before solidifying.

It should be clearly understood that the examples illustrated by FIGS. 1-9 are merely general applications of the principles of this disclosure in practice, and a wide variety of other examples are possible. Therefore, the scope of this disclosure is not limited in any manner to the details of any of the FIGURES described herein.

It is also to be recognized that the disclosed reactive metal elements may also directly or indirectly affect the various downhole equipment and tools that may come into contact with the reactive metal elements during operation. Such equipment and tools may include, but are not limited to: wellbore casing, wellbore liner, completion string, insert strings, drill string, coiled tubing, slickline, wireline, drill pipe, drill collars, mud motors, downhole motors and/or pumps, surface-mounted motors and/or pumps, centralizers, turbolizers, scratchers, floats (e.g., shoes, collars, valves, etc.), logging tools and related telemetry equipment, actuators (e.g., electromechanical devices, hydromechanical devices, etc.), sliding sleeves, production sleeves, plugs, screens, filters, flow control devices (e.g., inflow control devices, autonomous inflow control devices, outflow control devices, etc.), couplings (e.g., electro-hydraulic wet connect, dry connect, inductive coupler, etc.), control lines (e.g., electrical, fiber optic, hydraulic, etc.), surveillance lines, drill bits and reamers, sensors or distributed sensors, downhole heat exchangers, valves and corresponding actuation devices, tool seals, packers, cement plugs, bridge plugs, and other wellbore isolation devices, or components, and the like. Any of these components may be included in the systems generally described above and depicted in any of the FIGURES.

Provided are methods for cementing in accordance with the disclosure and the illustrated FIGURES. An example method comprises introducing a conduit into a wellbore. The conduit comprises a reactive metal element disposed on an exterior of the conduit. The reactive metal element comprises a reactive metal having a first volume. The method further comprises circulating a cement over the exterior of the conduit and the reactive metal element, contacting the reactive metal element with a fluid that reacts with the reactive metal to produce a reaction product having a second volume greater than the first volume, and contacting a surface of the cement adjacent to the reactive metal element with the reaction product.

Additionally or alternatively, the method may include one or more of the following features individually or in combination. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof. The reactive metal element may comprise a swellable non-metal element. The swellable non-metal element may be an elastomer. The reactive metal element may comprise a spacer element. A cup seal, end ring, or stamped ring proximate to the reactive metal. The conduit may be a surface casing or intermediate casing. The reactive metal element may be continuous along the entire exterior length of the conduit. The reactive metal element may be disposed along only a portion of the exterior length of the conduit.

Provided are systems for cementing in a wellbore in accordance with the disclosure and the illustrated FIGURES. An example system comprises a conduit disposed in the wellbore, a reactive metal element disposed on the exterior of the conduit and the reactive metal element comprises a reactive metal having a first volume, a reaction-inducing fluid capable of reacting with the reactive metal to produce a reaction product having a second volume that is greater than the first volume, and a cement circulated in the wellbore such that it surrounds the conduit and the reactive metal element.

Additionally or alternatively, the system may include one or more of the following features individually or in combination. The reactive metal may comprise a metal selected from the group consisting of magnesium, calcium, aluminum, tin, zinc, beryllium, barium, manganese, and any combination thereof. The reactive metal may comprise a metal alloy selected from the group consisting of magnesium-zinc, magnesium-aluminum, calcium-magnesium, aluminum-copper, and any combination thereof. The reactive metal element may comprise a swellable non-metal element. The swellable non-metal element may be an elastomer. The reactive metal element may comprise a spacer element. A cup seal, end ring, or stamped ring proximate to the reactive metal. The conduit may be a surface casing or intermediate casing. The reactive metal element may be continuous along the entire exterior length of the conduit. The reactive metal element may be disposed along only a portion of the exterior length of the conduit.

The preceding description provides various examples of the apparatus, systems, and methods of use disclosed herein which may contain different method steps and alternative combinations of components. It should be understood that, although individual examples may be discussed herein, the present disclosure covers all combinations of the disclosed examples, including, without limitation, the different component combinations, method step combinations, and properties of the system. It should be understood that the compositions and methods are described in terms of "comprising," "containing," or "including" various components or steps. The systems and methods can also "consist essentially of" or "consist of the various components and steps." Moreover, the indefinite articles "a" or "an," as used in the claims, are defined herein to mean one or more than one of the element that it introduces.

For the sake of brevity, only certain ranges are explicitly disclosed herein. However, ranges from any lower limit may be combined with any upper limit to recite a range not explicitly recited, as well as ranges from any lower limit may be combined with any other lower limit to recite a range not explicitly recited. In the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

One or more illustrative examples incorporating the examples disclosed herein are presented. Not all features of a physical implementation are described or shown in this application for the sake of clarity. Therefore, the disclosed systems and methods are well adapted to attain the ends and advantages mentioned, as well as those that are inherent therein. The particular examples disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown other than as described in the claims below. It is therefore evident that the particular illustrative examples disclosed above may be altered, combined, or modified, and all such variations are considered within the scope of the present disclosure. The systems and methods illustratively disclosed herein may suitably be practiced in the absence of any element that is not specifically disclosed herein and/or any optional element disclosed herein.

Although the present disclosure and its advantages have been described in detail, it should be understood that various changes, substitutions and alterations can be made herein without departing from the spirit and scope of the disclosure as defined by the following claims.

What is claimed is:

1. A method for cementing in a wellbore comprising:

introducing a conduit into a wellbore, wherein the conduit comprises a reactive metal element disposed on an exterior of the conduit, wherein the reactive metal element is disposed between a pair of retaining elements which are disposed on the conduit, wherein a spacer element is disposed on the conduit on each of the opposing sides of the retaining elements relative to the reactive metal element, wherein the spacer elements are outside of the retaining elements relative to the reactive metal element; wherein the retaining elements are cup seals, end rings, or stamped rings; wherein the spacer elements comprises a polymer-based material, and wherein the reactive metal element comprises a reactive metal having a first volume;

circulating a cement over the exterior of the conduit and the reactive metal element;

setting the cement; wherein the set cement comprises a void;

then contacting the reactive metal element with a fluid that reacts with the reactive metal to produce a reaction product having a second volume greater than the first volume; and contacting a surface of the cement adjacent to the reactive metal element with the reaction product.

2. The method of claim 1, wherein the reactive metal comprises a metal selected from the group consisting of magnesium, calcium, aluminum, tin, zinc, beryllium, barium, manganese, and any combination thereof.

3. The method of claim 1, wherein the reactive metal comprises a metal alloy selected from the group consisting of magnesium-zinc, magnesium-aluminum, calcium-magnesium, aluminum-copper, and any combination thereof.

4. The method of claim 1, wherein the reactive metal element comprises a swellable non-metal element.

5. The method of claim 4, wherein the swellable non-metal element is an elastomer.

6. The method of claim 1, wherein the conduit is a surface casing or intermediate casing.

7. The method of claim 1, wherein the reactive metal element is continuous along the entire exterior length of the conduit.

8. The method of claim 1, wherein the reactive metal element is disposed along only a portion of the exterior length of the conduit.

9. A system for cementing in a wellbore comprising:

a conduit disposed in the wellbore;

a reactive metal element disposed on the exterior of the conduit, the reactive metal element comprising a reactive metal having a first volume, wherein the reactive metal element is disposed between a pair of retaining elements which are disposed on the conduit, wherein a spacer element is disposed on the conduit on each of the opposing sides of the retaining elements relative to the reactive metal element, and wherein the spacer elements are outside of the retaining elements relative to the reactive metal element; wherein the retaining elements are cup seals, end rings, or stamped rings; wherein the spacer elements comprises a polymer-based material;

a reaction-inducing fluid capable of reacting with the reactive metal to produce a reaction product having a second volume that is greater than the first volume; and a cement circulated in the wellbore such that it surrounds the conduit and the reactive metal element; wherein the cement is set after surrounding the conduit; and wherein the reaction-inducing fluid contacts the reactive metal element and reacts with the reactive metal after the cement is set.

10. The system of claim 9, wherein the reactive metal comprises a metal selected from the group consisting of magnesium, calcium, aluminum, tin, zinc, beryllium, barium, manganese, and any combination thereof.

11. The system of claim 9, wherein the reactive metal comprises a metal alloy selected from the group consisting of magnesium-zinc, magnesium-aluminum, calcium-magnesium, aluminum-copper, and any combination thereof.

12. The system of claim 9, wherein the reactive metal element comprises a swellable non-metal element.

13. The system of claim 12, wherein the swellable non-metal element is an elastomer.

14. The system of claim 9, wherein the conduit is a surface casing or intermediate casing.

15. The system of claim 9, wherein the reactive metal element is continuous along the entire exterior length of the conduit.

16. The system of claim 9, wherein the reactive metal element is disposed along only a portion of the exterior length of the conduit.

17. The method of claim 1, wherein the reactive metal element was formed in a solid solution process.

18. The method of claim 1, wherein the reactive metal element was formed in a powder metallurgy process.

19. The system of claim 9, wherein the reactive metal element was formed in a solid solution process.

20. The system of claim 9, wherein the reactive metal element was formed in a powder metallurgy process.

* * * * *